US011952153B2

(12) United States Patent
Laghi et al.

(10) Patent No.: US 11,952,153 B2
(45) Date of Patent: Apr. 9, 2024

(54) SELF-PROPELLED WRAPPING MACHINE AND METHOD OF WRAPPING

(71) Applicant: ROBOPAC S.P.A., Acquaviva-Gualdicciolo (SM)

(72) Inventors: Pierangelo Laghi, Acquaviva-Gualdicciolo (SM); Luca Delbaldo, Acquaviva-Gualdicciolo (SM)

(73) Assignee: ROBOPAC S.P.A., Acquaviva-Gualdicciolo (SM)

( * ) Notice: Subject to any disclaimer, the term of this patent is extended or adjusted under 35 U.S.C. 154(b) by 453 days.

(21) Appl. No.: 17/434,095

(22) PCT Filed: Feb. 25, 2020

(86) PCT No.: PCT/IB2020/051593
§ 371 (c)(1),
(2) Date: Aug. 26, 2021

(87) PCT Pub. No.: WO2020/174388
PCT Pub. Date: Sep. 3, 2020

(65) Prior Publication Data

US 2022/0135263 A1 May 5, 2022

(30) Foreign Application Priority Data

Feb. 27, 2019 (IT) ..... 102019000002869

(51) Int. Cl.
*B65B 11/02* (2006.01)
*B65B 41/14* (2006.01)
(Continued)

(52) U.S. Cl.
CPC ..... *B65B 11/025* (2013.01); *B65B 41/14* (2013.01); *B65B 57/12* (2013.01); *B65B 61/06* (2013.01); *B65B 2210/14* (2013.01)

(58) Field of Classification Search
CPC ..... B65B 11/025; B65B 41/14; B65B 57/12; B65B 61/06; B65B 2210/14
See application file for complete search history.

(56) References Cited

U.S. PATENT DOCUMENTS 4,077,179 A * 3/1978 Lancaster ..... B65B 11/045 53/465
4,409,776 A 10/1983 Usui
(Continued)

FOREIGN PATENT DOCUMENTS

CN 1950260 4/2007
CN 104828269 8/2015
(Continued)

OTHER PUBLICATIONS

International Search Report dated May 12, 2020 in International (PCT) Application No. PCT/IB2020/051593.
(Continued)

*Primary Examiner* — Andrew M Tecco
*Assistant Examiner* — Nicholas E Igbokwe
(74) *Attorney, Agent, or Firm* — Wenderoth, Lind & Ponack, L.L.P.

(57) ABSTRACT

A self-propelled wrapping machine movable around a load to wrap the load with a plastic film in a wrapping cycle, comprising a self-propelled carriage; a upright fixed to the carriage and slidably supporting an unwinding unit provided at least with a reel of film; a first gripping unit that is supported by the carriage, and is movable and arranged to hold and unwind an initial flap of film from the unwinding unit in an initial step of the wrapping cycle; and a second gripping unit that is supported by the carriage, and is movable and arranged to position and release an anchoring element on the initial flap of film in the initial step of the wrapping cycle so as to fix the initial flap of film to a supporting plane and to grasp and lift the anchoring element
(Continued)

from the supporting plane so as to disengage it from the initial flap of film after at least one turn of the self-propelled wrapping machine around the load wrapping the load with the film supplied by the unwinding unit.

12 Claims, 8 Drawing Sheets

(51) Int. Cl.
*B65B 57/12* (2006.01)
*B65B 61/06* (2006.01)

(56) References Cited

U.S. PATENT DOCUMENTS

| | | | | |
|---|---|---|---|---|
| 7,520,110 | B2 | 4/2009 | Asioli | |
| 10,689,138 | B2 | 6/2020 | Laghi | |
| 10,703,519 | B2 | 7/2020 | Ceré | |
| 11,492,154 | B2 | 11/2022 | Laghi | |
| 2007/0169442 | A1* | 7/2007 | Asioli | B65B 11/025 53/588 |
| 2012/0042615 | A1* | 2/2012 | Roche | B65B 11/025 53/461 |
| 2014/0053502 | A1* | 2/2014 | Pecchenini | B65B 11/025 53/218 |
| 2017/0320602 | A1* | 11/2017 | Laghi | B65B 11/025 |
| 2019/0002138 | A1* | 1/2019 | Laghi | B65B 41/16 |

FOREIGN PATENT DOCUMENTS

| | | |
|---|---|---|
| CN | 107031885 | 8/2017 |
| CN | 107848642 | 3/2018 |
| CN | 107848652 | 3/2018 |
| EP | 1 852 352 | 11/2007 |
| EP | 2 974 642 | 1/2016 |
| WO | 2012/153248 | 11/2012 |
| WO | 2013/050832 | 4/2013 |

OTHER PUBLICATIONS

Office Action dated Jun. 13, 2022 in corresponding Chinese Patent Application No. 202080016047.0, with English-language translation.

* cited by examiner

SELF-PROPELLED WRAPPING MACHINE AND METHOD OF WRAPPING

The invention relates to a mobile or self-propelled wrapping machine arranged to wrap a film made of a plastic material around a load consisting of a product or a group of products arranged on a skid or pallet. The invention also relates to a wrapping method implemented by the aforementioned self-propelled wrapping machine.

Self-propelled wrapping machines, also referred to as self-propelled wrapping robots, are machines generally used to wrap loads having variable shapes and sizes and in productions in limited amounts, typically in environments or rooms where fixed or static wrapping machines cannot be used because of the overall dimensions and/or available spaces. Loads are generally formed by skids or pallets on which a group of more or less regularly overlapped products and/or objects, even having different sizes and formats, is arranged. In other cases, wrapping, normally for protective purposes, directly concerns the product, which is generally large-sized.

The self-propelled wrapping machines include a cart or carriage that supports a vertical upright along which a film unwinding or supplying unit, which houses a reel of plastic film and is generally provided with a plurality of rollers for unwinding and pre-stretching the film, is movable with alternating rectilinear motion. More precisely, the unwinding unit is provided with a pair of pre-stretching rollers suitable for unwinding the film from the reel and pre-stretching or extending it by a predefined percentage, and one or more return rollers to divert the film towards the load.

The carriage is usually provided with motorized rear traction wheels and a front driving device which includes one or more steering wheels, operated by a steering. The steering may be operated via a guide bar by an operator to manually drive the machine in a manoeuvring configuration, or from a feeler element capable of following the profile or external shape of the load in an operational working configuration, in which the self-propelled machine turns autonomously and automatically around the load to wrap it with the film.

The combination of the alternating linear movement of the unwinding unit along the vertical upright and the rotation of the self-propelled machine around the load allows the film to be wrapped around the load so as to form a series of intertwined strips or bands. The plastic film is wrapped to completely bind up the load on all its sides.

The feeler element comprises an arm extending externally and laterally with respect to the carriage and is provided at its end with an idle wheel capable of following the external outline of the load to be wrapped. The feeler element exerts a predefined elastic compression or thrust force on the load, so as to maintain contact with the aforementioned load and to allow the machine to move reliably around the load according to a trajectory determined by the outline of the load itself.

Self-propelled wrapping machines are also known that include sensors instead of the feeler element, such as ultrasonic sensors, capable of detecting the external surfaces and edges of the load and processing related signals which allow a control unit of the wrapping machine to calculate a wrapping path around the load which avoids collisions. More precisely, based on the external surfaces and edges of the load detected by the sensors, the control unit controls the steering wheels and/or the driving wheels of the carriage so as to steer and drive the latter around the load.

In both types of known self-propelled wrapping machines described above, although the wrapping step takes place in a substantially automatic way, i.e. without manual intervention by an operator, the operator is needed both in an initial step of the wrapping process to fix an initial flap of the film to the load or to the underlying pallet and in a final step to cut the film and separate it from the reel.

Therefore, the aforementioned known self-propelled wrapping machines have the disadvantage of not allowing to carry out wrapping processes in a fully automated way, that is, without any manual intervention by operators.

EP 18522352 discloses a fixing assembly for a wrapping film associated with a self-propelled wrapping machine of the type comprising a frame supported by wheels, at least one of which is a driving one, above which a column supporting the film reel is arranged. The fixing assembly comprises a mobile cart provided with a motor member and having a gripper for grasping the free end of the film, and means for cutting a portion of the film. The wrapping machine comprises a compartment for housing the mobile cart.

EP 2974642 discloses a self-propelled wrapping machine comprising a frame with a pair of non-steering wheels, a lifting system with an upright, and a mobile cart to which a reel-holder assembly is fixed, and at least one manoeuvring wheel connected to a support connected to the frame so that it can rotate with respect to it about a substantially vertical axis. The wrapping machine comprises a cleaning device for cleaning a floor or a ground surface that is connected to the frame and/or the upright, and a control device for the manoeuvring wheel that allows to easily drive the wrapping machine during cleaning operations. The driving of the wrapping machine during the cleaning operations may be carried out by an operator-less automatic driving system.

WO 2013/050832 discloses a self-propelled wrapping machine comprising a self-propelled motorized cart, suitable for moving on the ground by at least two driving wheels whose rotation determines the movement trajectory of the machine, a control unit for controlling the movement of the driving wheels, means for supplying a load wrapping material supported by the cart, and a distance detector positioned on the machine and capable of detecting the distance between the machine and the load. The distance detector is also configured to send a correction signal to the control unit when the distance falls below a predetermined threshold distance and the control unit is configured to vary the main trajectory radius for a relatively short time, following the emission of the correction signal, by imposing a corrective trajectory such as to bring the centre of the main trajectory closer to the axis of the load and subsequently impose the main trajectory again on the machine. US 2012/042615 discloses a cart apparatus for supplying an extensible plastic film unwound from a reel and suitable for wrapping a pallet of stacked bulk goods. The apparatus comprises a transportable frame provided with wheels or castors which provides support and mobility and includes means for adjusting the height of the film reel. The frame is provided with a guide roller positioned and used as a fulcrum point to generate tension in the extensible wrapping film and with a knife to detach the extensible wrapping film at the end of the operation, the end of the extensible wrapping film being held for subsequent use.

U.S. Pat. No. 4,409,776 discloses an apparatus for packing an item with an extensible composite film having one adhesive side and the other non-adhesive side; the apparatus comprises supporting means for supporting an item to be packed with the composite film, a base plate adjacent to the supporting means and supporting a supporting frame which supports a reel of unstretched continuous composite film and means for applying a tension to the composite film when it is unwound from the reel in order to stretch it. The apparatus further comprises means for rotating the support means and the base plate so as to wrap the stretched composite film around the item and forming a first and a second layer, and means for rotating the supporting frame about an axis parallel to the longitudinal axis of the film so that, after the first layer of film is wrapped around the item with the non-adhesive side in contact with the item, the supporting frame of said film is rotated to wrap the second layer of film with the adhesive side in contact with the first layer.

An object of the invention is to improve the known self-propelled wrapping machines arranged to wrap a load with a film made of an extensible plastic material.

Another object is to provide a self-propelled wrapping machine which allows to wrap a load with a film completely automatically, without requiring any manual intervention by an operator.

A further object is to provide a self-propelled wrapping machine which allows to make firm and stable wrappings.

In a first aspect of the invention a self-propelled wrapping machine according to claim 1 is provided.

In a second aspect of the invention a wrapping method according to claim 10 is provided.

The invention can be better understood and implemented with reference to the attached figures which illustrate an exemplary and non-limiting embodiment thereof, wherein.

Figure 1:
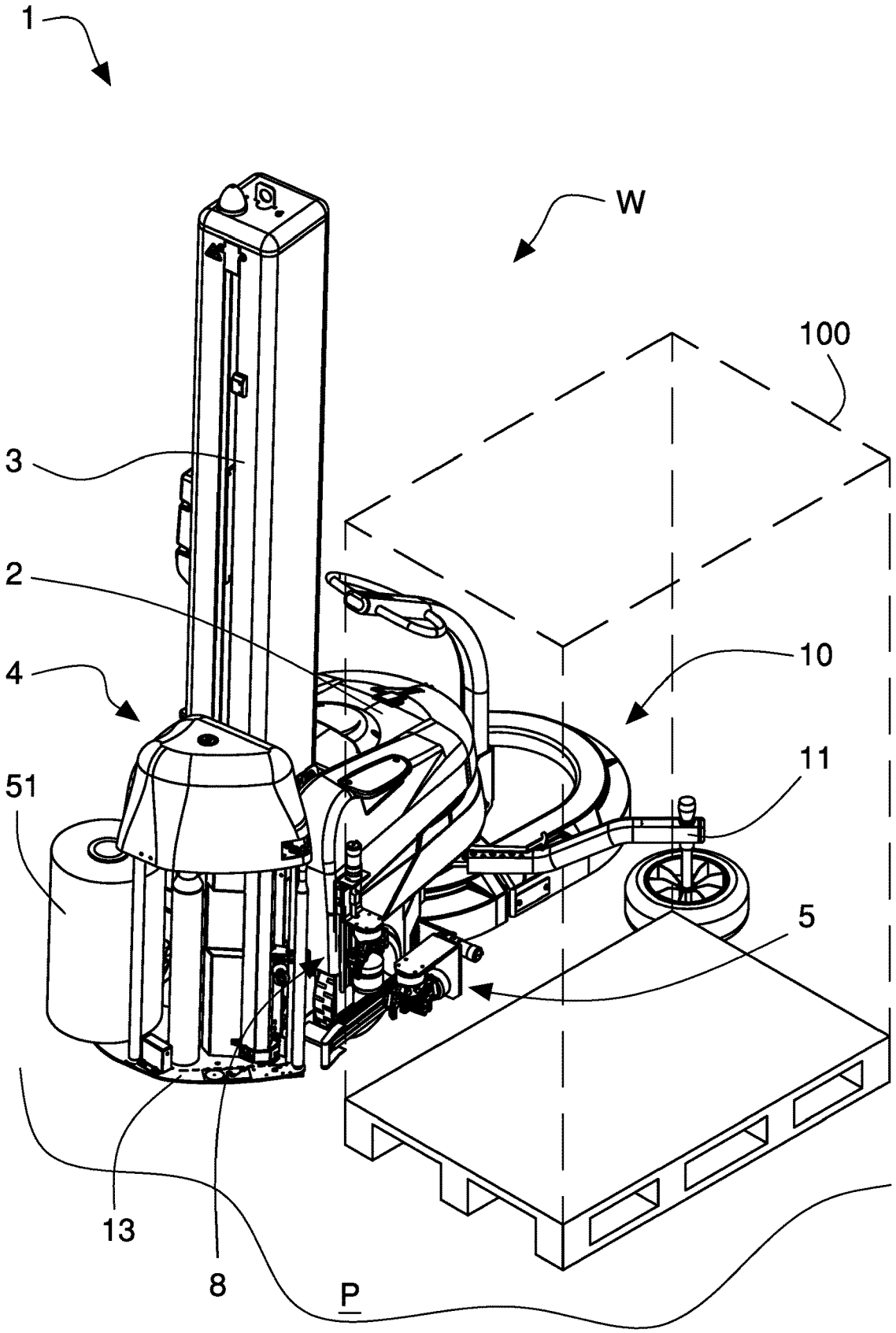
FIG. 1 is a perspective view of the self-propelled wrapping machine of the invention associated with a palletised load represented in a dotted line.
Figure 2:
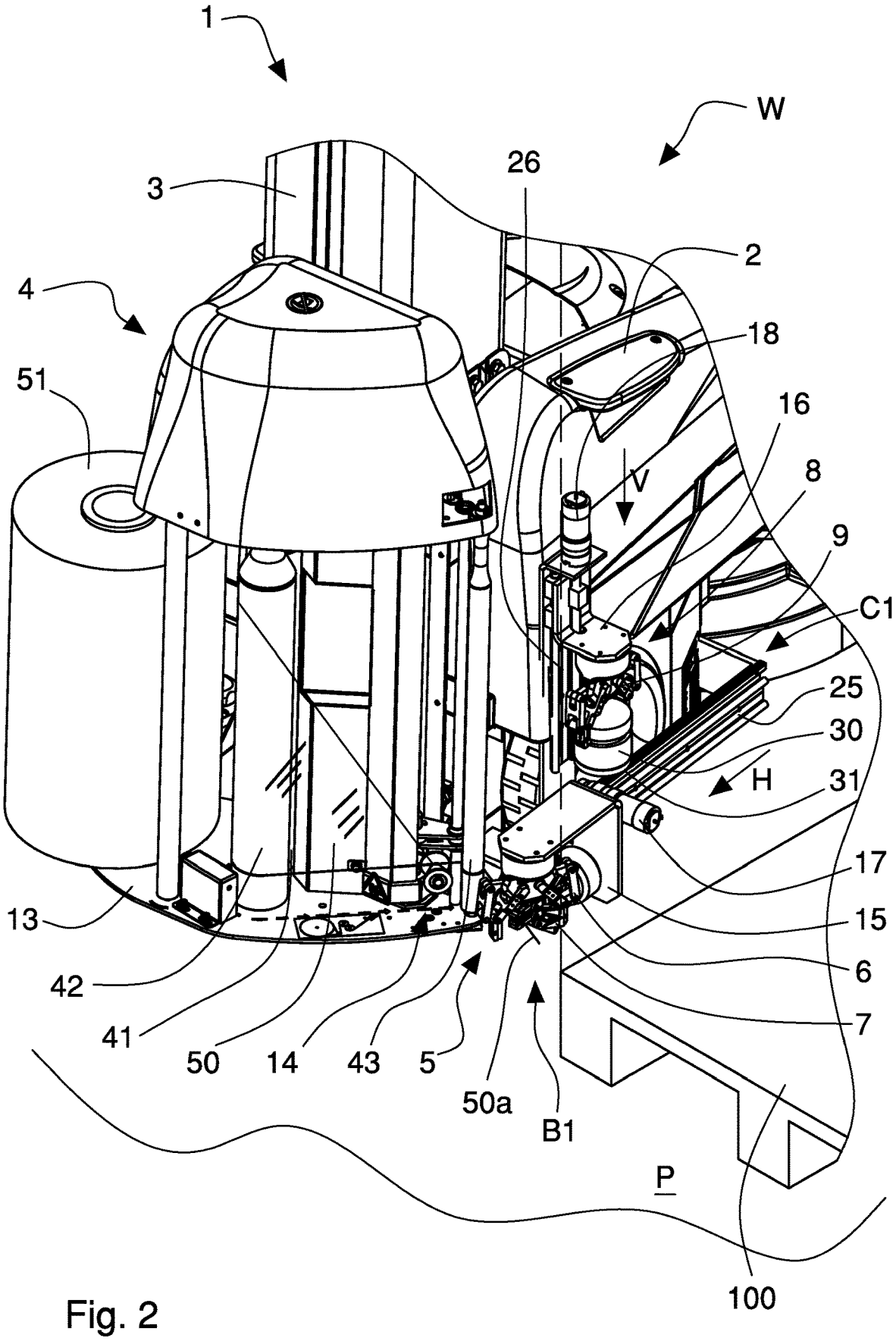
FIGS. 2 to 8 are partial and enlarged perspective views of the wrapping machine of FIG. 1 in respective different steps of a load wrapping cycle.

Referring to FIGS. 1 to 8, there is shown a self-propelled wrapping machine 1 according to the invention, movable around a load 100 to wrap it with a film 50 made of a plastic material, in particular of the cold-extensible type, during a wrapping cycle. The load 100 consists, for example, of one or more products arranged on a pallet or skid.

The self-propelled wrapping machine 1 comprises a self-propelled or mobile carriage 2 and an upright 3 fixed to the latter and slidably supporting an unwinding unit 4. The unwinding unit 4 is provided with a reel 51 of film 50 and roller means 41, 42, 43 for unwinding and pre-stretching the film 50. The upright 3 is substantially vertical.

The self-propelled wrapping machine 1 further comprises a first gripping unit 5 and a second gripping unit 8 both fixed to a side of the carriage 2.

The first gripping unit 5, supported by, and connected to, the carriage 2, is mobile and arranged to hold and unwind an initial flap 50*a* of film 50 from the unwinding unit 4 in an initial step of the wrapping cycle. The initial flap 50*a* of film, retained and unwound by the first gripping unit 5, is generated in a previous wrapping cycle performed by the self-propelled wrapping machine, as better explained further in the description.

The second gripping unit 8, supported by and connected to, the carriage 2, is mobile and arranged to position and release an anchoring element 30 on the initial flap 50*a* of film unwound by the first gripping unit 5 in the initial step of the wrapping cycle, so as to lock the initial flap, thanks to the weight of said anchoring element 30, to a supporting plane P (typically the ground or floor of a production site) on which the self-propelled wrapping machine 1 moves. The second gripping unit 8 is also arranged to grasp and lift the anchoring element 30 from the supporting plane P so as to disengage it from the initial flap 50*a* of film after the self-propelled wrapping machine 1 has travelled at least one turn around the load 100 wrapping the latter with the film 50 supplied by the unwinding unit 4, i.e. after the film 50 has been partially wrapped and therefore fixed to the aforementioned load 100.

The first gripping unit 5 comprises first gripping means 6 suitable for grasping and holding the film 50, and is movable, in particular linearly, between a picking position B1, wherein the first gripping means 6 are adjacent to the unwinding unit 4 so as to grasp and hold the initial flap 50*a* of film, and a releasing position B2, wherein the first gripping means 6 are spaced from the unwinding unit 4 to unwind said initial flap 50*a* of film, in particular a section of film having defined length which may be conveniently locked to the supporting plane P by the anchoring element 30.

The first gripping means 6 comprises, for example, first pliers having two noses or jaws that are opened or closed by a respective electric actuator.

The first gripping unit 5 further comprises cutting means 7 arranged to cut the film 50 unwound by the unwinding unit 4 and held by the first gripping means 6 in an end step of the wrapping cycle so as to generate the initial flap 50*a* of film, held by the same first gripping means 6, and an end flap 50*b* to be fixed to the load 100 to complete the wrapping. In particular, the cutting means 7 cut the portion of film 50 comprised between the unwinding unit 4 and the load 100.

The cutting means 7 comprise, for example, pliers having two jaws one of which is provided with a "V" blade that is opened or closed by a respective electric actuator. The first gripping unit 5 includes a first slide 15, which is slidably connected to the carriage 2, movable along a first operating direction H, in particular nearly parallel to the supporting plane P, i.e. substantially horizontal, and supports the first gripping means 6 and the cutting means 7. More precisely, the first slide 15 can slide along a first linear guide 25 fixed to an internal side of the carriage 2 and is operated between the picking position B1 and the releasing position B2 by first actuator means 17, for example of the electric type. The internal side of the carriage 2 is the side facing the load 100 during the wrapping cycle.

The second gripping unit 8 comprises second gripping means 9 arranged to grasp and hold the anchoring element 30, and is movable, in particular linearly, between a raised position C1 and a lowered position C2.

In the raised position C1 of the second gripping unit 8, the second gripping means 9 is more spaced from the supporting plane P, in particular in order to not interfere with the wrapping of the load, whether supporting or not the anchoring element 30, as better explained further in the description.

In the lowered position C2 of the second gripping unit 8 the second gripping means 9 is more adjacent to the supporting plane P in order to release the anchoring element 30 on the initial flap 50*a* of film and the supporting plane P, or to grasp and lift the anchoring element 30 from the supporting plane P and disengage it from the initial flap 50*a*. The second gripping means 9 comprise, for example, second pliers having two noses or jaws that are opened or closed by a respective electric actuator. The ends of the jaws have respective protrusions suitable for engaging respective abutting seats of the anchoring element 30 so as to ensure a proper and firm grip thereof by the second gripping means 9, and in particular the lifting.

The anchoring element 30 has, for example, a cylindrical shape and is provided with a flat base wall 31, suitable for abutting against and locking the initial flap 50*a* of film to the supporting plane P, and has a weight, for example, of at least 3.5 kg, such as to ensure the firm and reliable locking of the initial flap 50*a* to the supporting plane P during the first wrapping turn of the self-propelled wrapping machine 1 around the load 100.

The anchoring element 30 also comprises a cylindrical side wall 32 provided with an annular groove 33 acting as an abutting seat for the protrusions of the jaws of the second pliers 9.

The second gripping unit 8 comprises a second slide 16 which is slidably connected to the carriage 2, movable along a second operating direction V, in particular nearly orthogonal to the supporting plane P, i.e. substantially vertical, and supporting the second gripping means 9. More precisely, the second slide 16 can slide along a second linear guide 26 fixed to the internal side of the carriage 2 and is operated between the raised position C1 and the lowered position C2 by second actuator means 18, for example of the electric type.

The fixing positions of the first gripping unit 5 and the second gripping unit 8 to the internal side of the carriage 2 are defined so as to ensure that the anchoring element 30 is deposited by the second gripping unit 8 exactly on the section of the initial flap 50*a* of film unwound by the first gripping unit 5 so as to push downwards and lock with its weight the aforementioned initial flap 50*a* of film to the supporting plane P.

The unwinding unit 4 comprises frame means 13 suitable for supporting the reel 51 and the roller means 41, 42, 43, which are arranged to unwind the film 50 from the reel 51, pre-stretch it and divert it towards the load 100. More precisely, the roller means comprises a pair of pre-stretching rollers 41, 42 and one or more guiding rollers 43. The pair of pre-stretching rollers comprises a first pre-stretching roller 41 and a second pre-stretching roller 42, rotating around respective longitudinal axes with different speeds so as to stretch or extend the film 50 during unwinding from the reel 51 and before wrapping around the load 100.

The unwinding unit 4 further comprises folding means 14 for transversely rolling up and/or narrowing the film 50 exiting from the roller means 41, 42, 43, so as to reduce a band width or largeness of the film and, in particular, make a rolled portion or a cord of film. This cord is obtained by progressively rolling up on itself at least one of the longitudinal edges of the film, transversely to the unwinding direction. The film 50 rolled in a cord can be grasped more firmly by the first gripping means 6 and more easily cut by the cutting means 7 of the first gripping unit 5 and form the two rolled flaps, the initial one 50*a* and the end one 50*b*.

The folding means 14, of known type and not described and illustrated in detail, comprises at least one folding element 14*a* moved by respective actuation means transversely to an unwinding direction of the film 50 so as to catch and abut a first longitudinal edge of the film 50 and progressively pushing and rolling the first longitudinal edge towards an opposite second longitudinal edge of the film 50, thus forming a cord.

The carriage 2 comprises two or more traction wheels 21, a directional wheel and guiding means 10 for guiding the self-propelled wrapping machine 1 along a wrapping path around the load 100. More precisely, the self-propelled wrapping machine 1 is provided with a pair of rear traction wheels 21 operated by motor means and with a front directional wheel. In the illustrated embodiment, the guiding means 10 comprises a feeler arm 11, of a known type, arranged to follow an external profile of the load 100 during the wrapping step and connected to the directional wheel to steer the latter and move the carriage 2 along the wrapping path.

Alternatively, in a variant not shown of the self-propelled wrapping machine 1, the latter may comprise sensors capable of detecting external surfaces and edges of the load 100 and processing related signals, and a control unit suitable for receiving the aforementioned signals from the sensors, calculating a wrapping path such as to avoid collisions with the load 100 and controlling the guiding means 10 so as to guide the self-propelled wrapping machine 1 along the wrapping path. In this variant, the guiding means 10 comprises actuator means controlled by the control unit and arranged to steer the directional wheel or actuation means also controlled by the control unit and arranged to vary the speed of the traction wheels 21.

The control unit of the self-propelled wrapping machine 1 is also arranged to control in a coordinated way the movement of the carriage 2 around the load 100, the supply of the film 50 by the unwinding unit 4, the movement thereof along the upright 3, the operation of the gripping units 5, 8 in the different steps of the wrapping cycle.

The self-propelled wrapping machine 1 is also provided with sensor means, of known type, for example comprising photocells or capacitive sensors or the like, capable of detecting the overall dimensions and size of the load 100 and the distances between the latter and the self-propelled wrapping machine 1 during operation. The signals of the sensor means are sent to the control unit of the machine to allow the proper execution of the different steps of the wrapping cycle.

In operation, the self-propelled wrapping machine 1 of the invention substantially performs a cycle for wrapping the load 100.

In an initial setting step, the self-propelled wrapping machine 1 is positioned adjacent to the load 100, and then activated so as to move around the load 100 for at least one turn in order to calculate and identify a defined initial position W at the beginning of the wrapping cycle. More precisely, thanks to the sensor means which detect the overall dimensions and size of the load 100, the control unit is able to stop the self-propelled wrapping machine in a proper initial position W.

Figure 3:
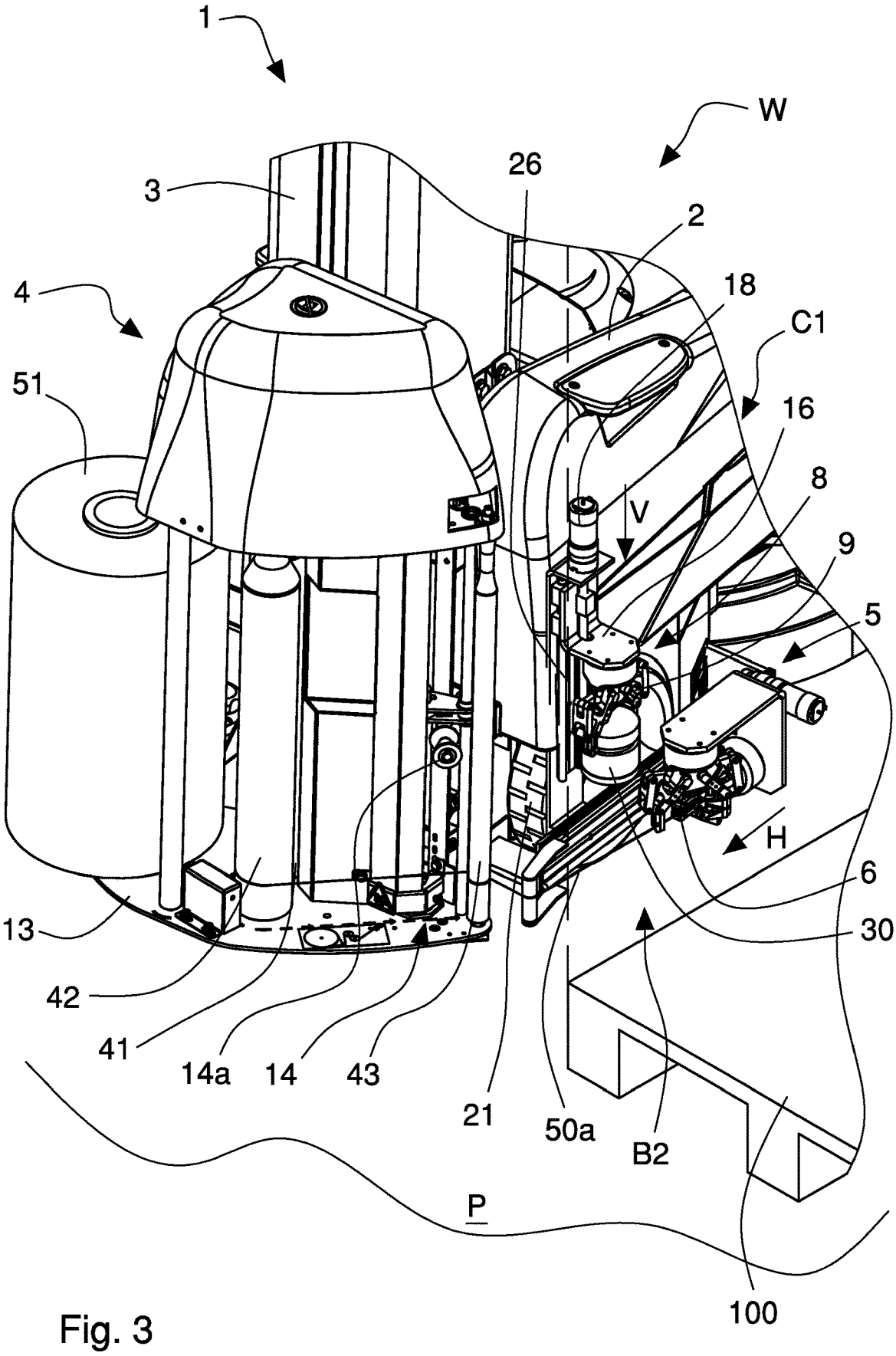

The first gripping unit 5, which is in the picking position B1 adjacent to the unwinding unit 4 and holds by means of the first gripping means 6 the initial flap 50*a* of film, obtained by cutting the film at the end of a previous wrapping cycle (FIG. 2), is moved into the releasing position B2 so as to unwind the initial flap 50*a* of film by a section with a defined length (FIG. 3). The initial flap 50 of film was rolled up in the form of a cord by the folding means 14 of the unwinding unit 4 in the previous wrapping cycle.

Figure 4:
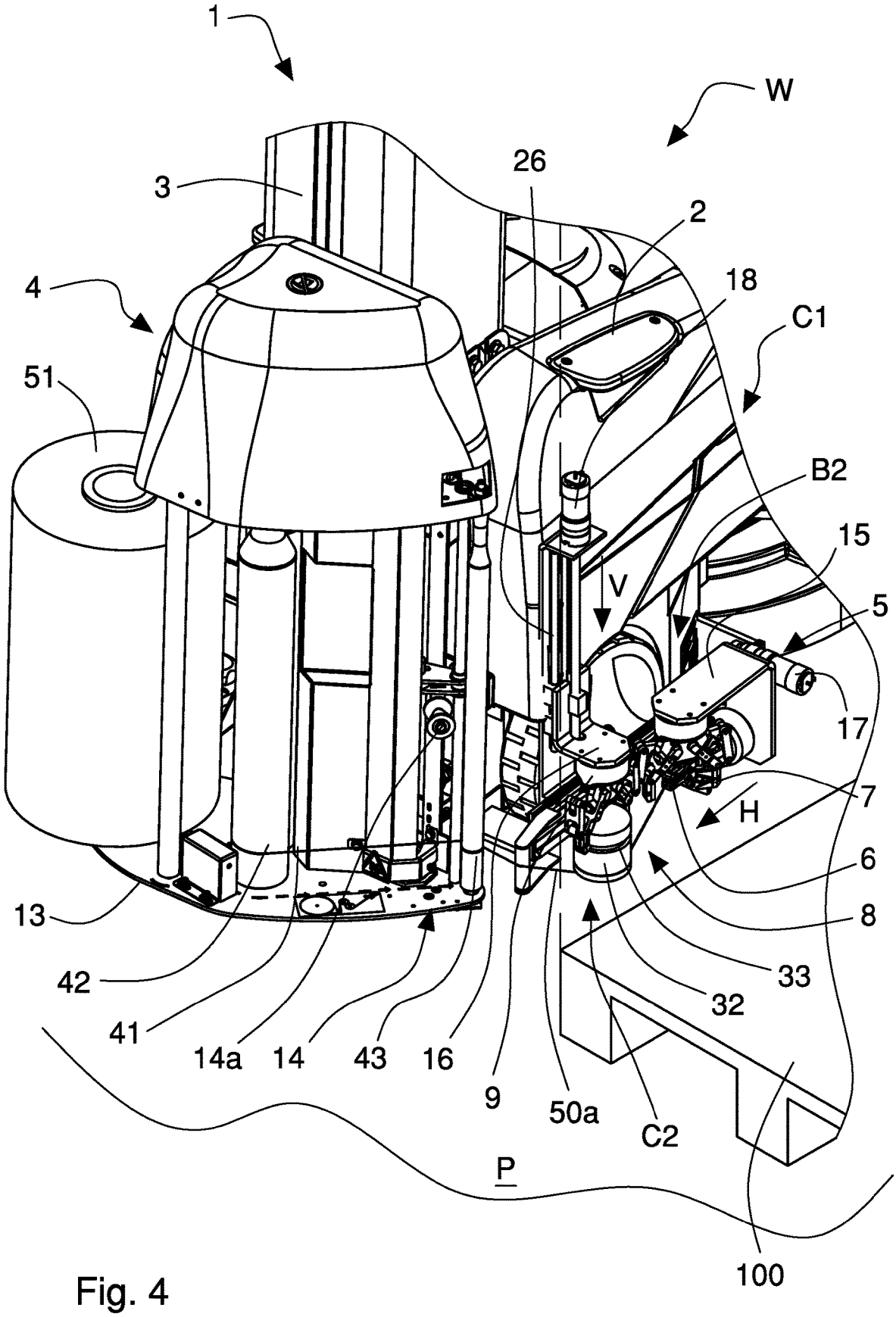

The initial flap 50*a* is then pushed downwards and locked on the supporting plane P by the anchoring element 30 deposited by the second gripping unit 8 moved from the raised position C1 to the lowered position C2 (FIG. 4).

Figure 5:
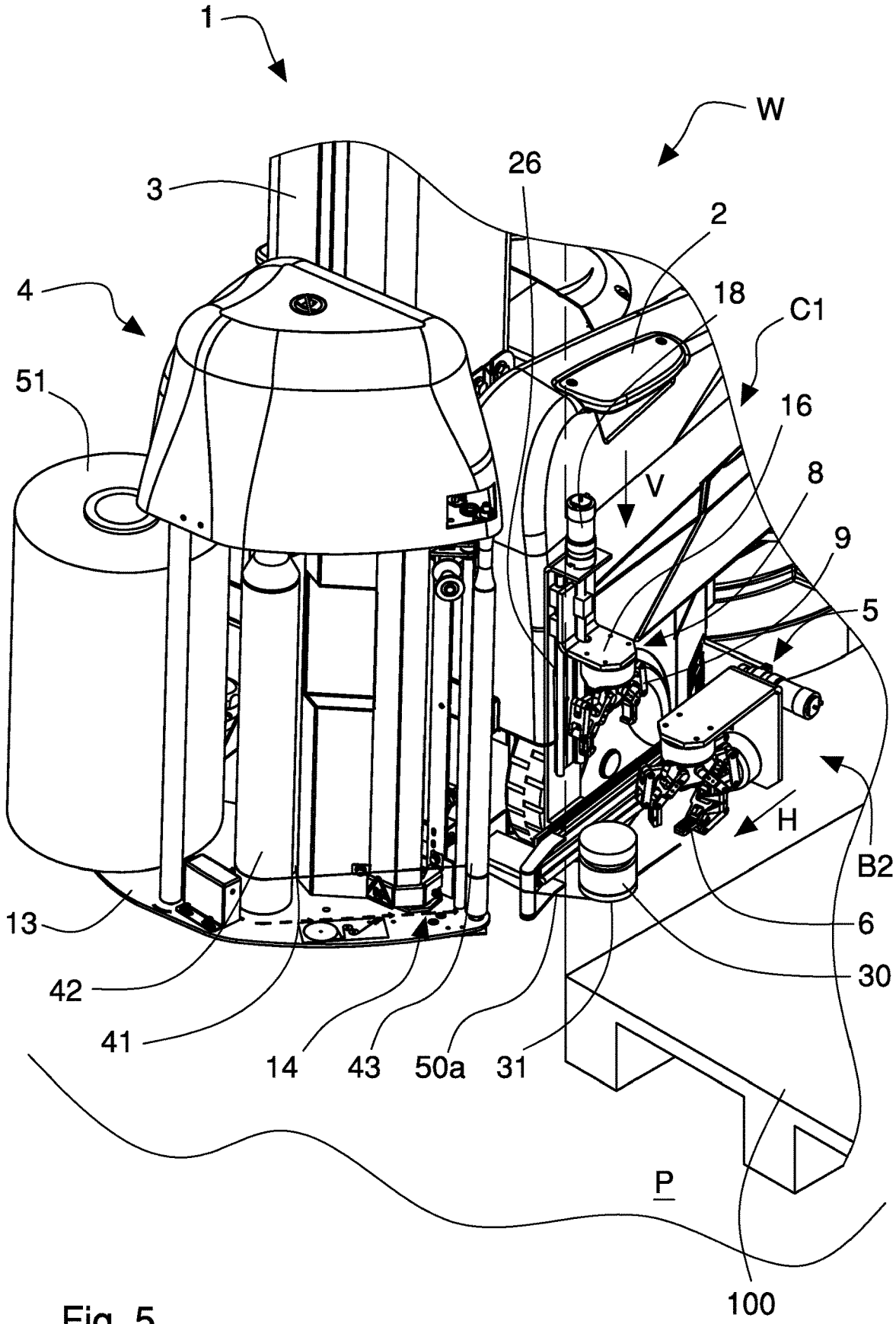

At this stage, the first gripping means 6 of the first gripping unit 5 and the second gripping means 9 of the second gripping unit 8 are opened so as to release the initial flap 50*a* and the anchoring element 30, respectively (FIG. 5).

The self-propelled wrapping machine 1 is moved around the load 100 for at least one turn so as to wrap the latter with the film 50 supplied by the unwinding unit 4. The film 50, whose initial flap 50*a* is locked and fixed to the supporting surface P by the anchoring element 30, is wrapped and adheres and fastens firmly to the load 100. The film 50 is supplied by the unwinding unit 4 at full height, i.e. not transversely rolled or narrowed.

Figure 6:
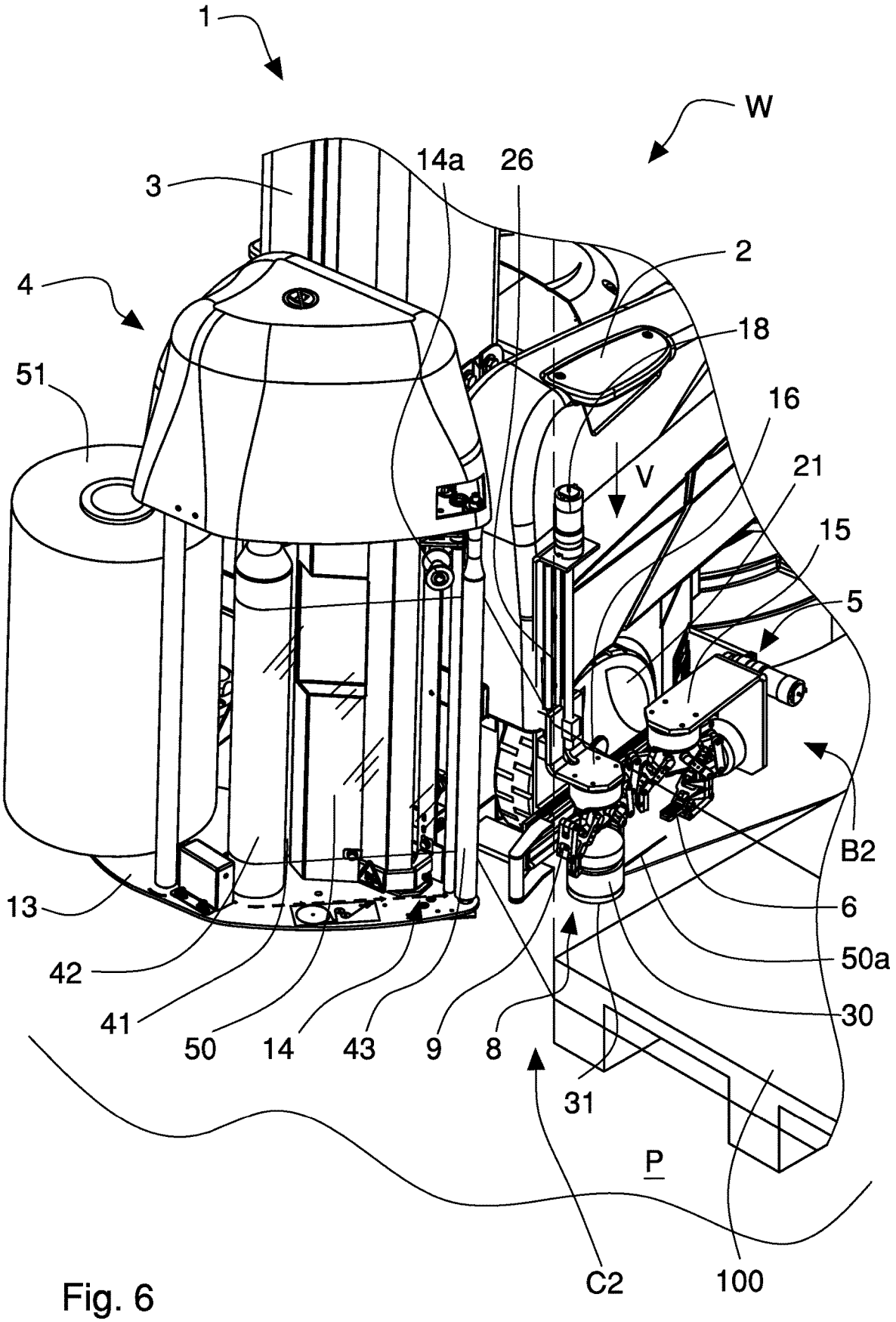

The self-propelled wrapping machine 1 is then stopped in the defined initial position W to allow the second gripping unit 8 to grasp and lift the anchoring element 30 from the supporting plane P so as to disengage the anchoring element from the initial flap 50*a* of film (FIG. 6). In particular, the second gripping unit 8 is moved from the lowered position C2, wherein the second gripping means 9 are closed to grasp the anchoring element 30, to the raised position C1, wherein the aforementioned second gripping unit 8 and the anchoring element 30 do not interfere with the wrapping of the load 100.

Figure 7:
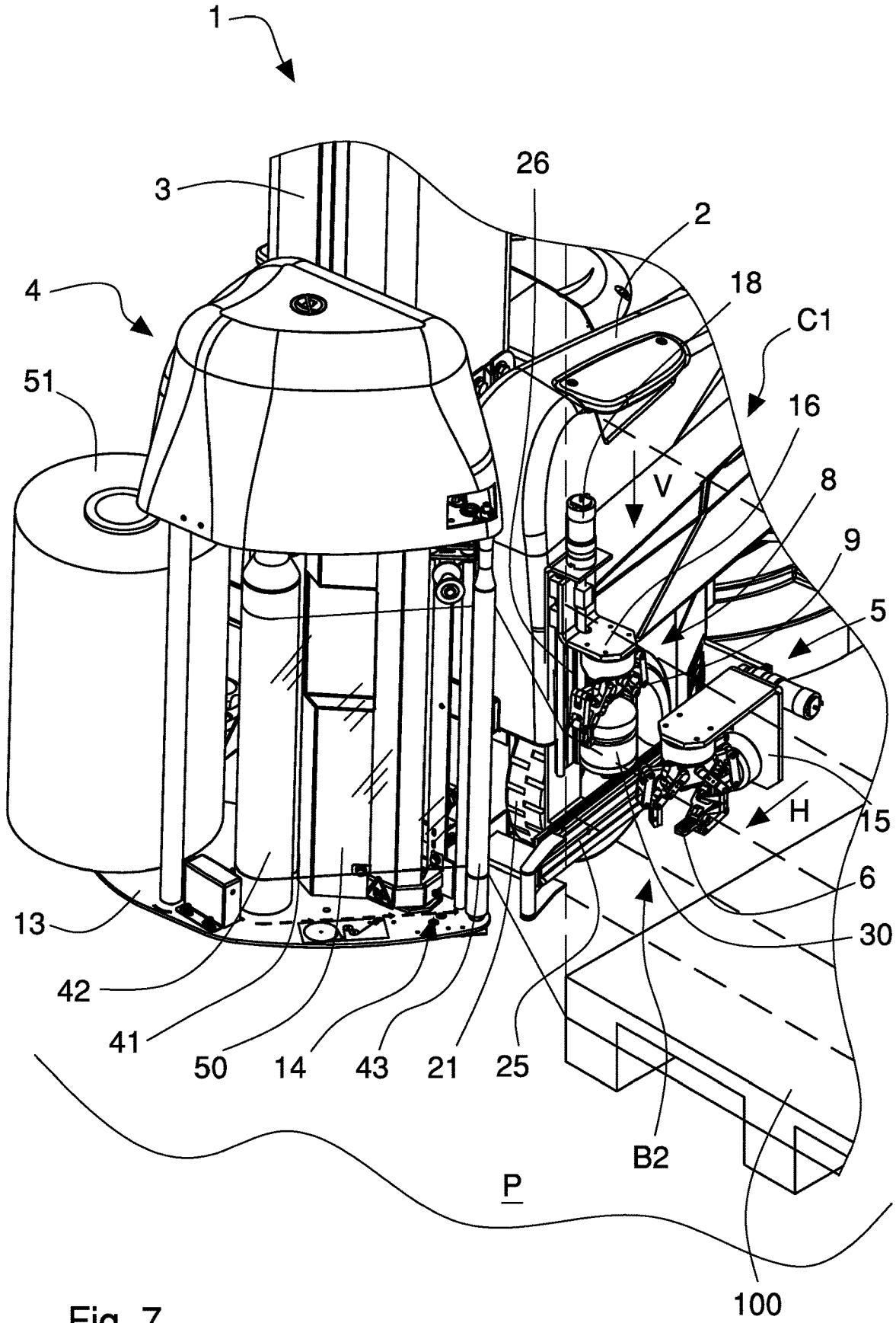

At this stage, the self-propelled wrapping machine 1 may be activated again to move around the load 100 for a defined number of turns so as to wrap the load with the film 50 according to a defined wrapping configuration (FIG. 7). During the rotation of the carriage 2 around the load 100, wrapping comprises moving the unwinding unit 4 with alternate motion along the upright 3 and simultaneous supply the pre-stretched film 50.

In the last wrapping turn the folding means 14 of the unwinding unit 4 are operated so as to transversely roll and/or narrow the film 50 exiting from the unwinding unit 4. Preferably, the film 50 is transversely narrowed and rolled by the folding means 14 so as to form a cord which can be grasped and held more firmly by the first gripping means 6 and cut more effectively and easily by the cutting means 7 of the first gripping unit 5.

Figure 8:
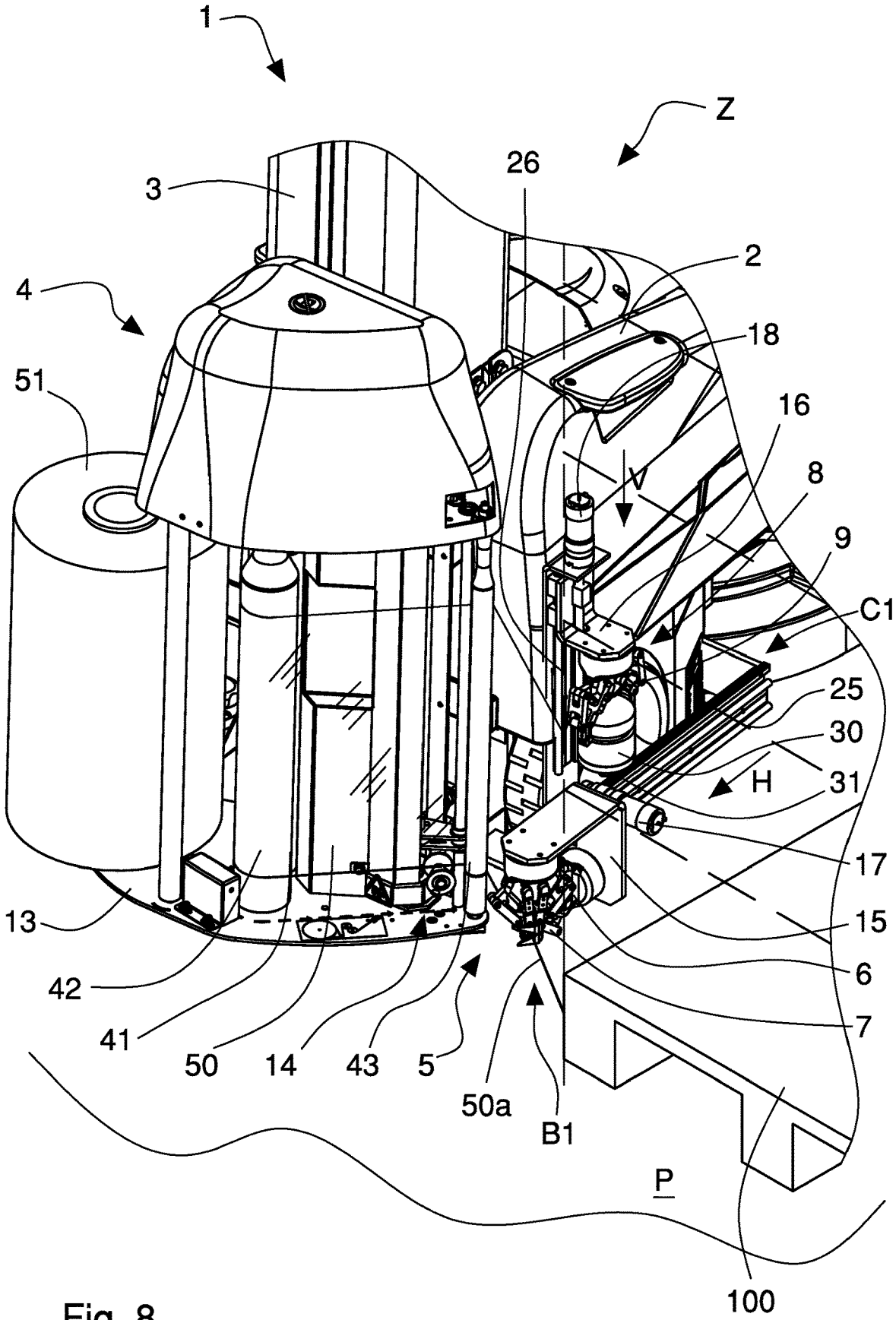

At the end of the wrapping, the self-propelled wrapping machine 1 is stopped in a defined final position Z, possibly coinciding with the defined initial position W, wherein the first gripping unit 5, which was in the releasing position B2, is moved to the picking position B1 to allow the first gripping means 6 and the cutting means 7 to grasp and then cut, respectively, the portion of film 50 rolled in the form of a cord that is comprised between the unwinding unit 4 and the load 100 in order to generate the initial flap 50*a* held by the first gripping means 6 of the first gripping unit 5 and the end flap 50*b* associated with the load 100 (FIG. 8).

The self-propelled wrapping machine 1 of the invention allows to wrap a load 100 with a film 50 completely automatically, that is, without requiring manual intervention by the operator, both in an initial step of the wrapping cycle, wherein it is required to hold an initial flap 50*a* of the film during a first wrapping turn of the film 50 around the load 100, and in a final step, wherein the film 50 has to be cut, and the initial and end flaps of the film generated by the cut have to be held.

In an initial step of the load wrapping cycle 100, the anchoring element 30 that is positioned and released by the second gripping unit 8 on the initial flap 50*a* of film unwound by the first gripping unit 5 thank to its weight, allows the aforementioned initial flap 50*a* to be locked securely and safely. The anchoring element 30 is then retrieved by the second gripping unit 8 after the film 50 has been suitably wrapped and fixed to the load with at least one wrapping turn, so as not to hinder the subsequent wrapping step. These operations are performed completely automatically, managed by the control unit of the self-propelled wrapping machine 1.

Also the operation at the end of the wrapping cycle, which provides to grasp and cut the film 50 in order to obtain both the initial and end flaps of the film, is performed completely automatically by the self-propelled wrapping machine 1.

The method according to the invention for wrapping a load 100 by means of the self-propelled wrapping machine 1 described and illustrated in FIGS. 1 to 8 comprises a wrapping cycle including the following operating steps:

positioning the self-propelled wrapping machine 1 adjacent to the load 100 in a defined initial position W;

unwinding from the unwinding unit 4 an initial flap 50*a* of film, in particular generated in a previous wrapping cycle, in particular rolled in the form of a cord, by moving the first gripping unit 5 which holds the aforementioned initial flap 50*a* from the picking position B1 to the releasing position B2;

locking the initial flap 50*a* of film unwound by the first gripping unit 5 to the supporting plane P on which the wrapping machine 1 moves, by positioning the anchoring element 30 above said initial flap by means of the second gripping unit 8 moved into the lowered position C2;

releasing the initial flap 50*a* and the anchoring element 30 by disengaging them from the first gripping unit 5 and from the second gripping unit 8, respectively;

moving the self-propelled wrapping machine 1 around the load 100 for at least one turn, wrapping the latter with the film 50 supplied by the unwinding unit 4, in particular at full height;

stopping the self-propelled wrapping machine 1 in the defined initial position W and lifting the anchoring element 30 from the supporting plane P so as to disengage the initial flap 50*a* by means of the second gripping unit 8 moved from the lowered position C2 to the raised position C1;

moving the self-propelled wrapping machine 1 around the load 100 for a defined number of turns, and wrapping the load with the film 50;

stopping the self-propelled wrapping machine 1 in a defined final position Z and grasping and cutting with the first gripping unit 5 the portion of film 50 comprised between the unwinding unit 4 and the load 100 in order to generate an initial flap 50*a* of film held by the first gripping unit 5 and an end flap 50*b* associated with the load 100.

The method also provides, before positioning the self-propelled wrapping machine 1 in the defined initial position W, moving the latter around the load 100 for at least one turn so as to calculate and identify the aforementioned defined initial position W.

The method also provides, before stopping the self-propelled wrapping machine 1 in the defined final position Z, in particular at the end of the step of wrapping the load, transversely rolling and/or narrowing the film 50 exiting from the unwinding unit 4.

The invention claimed is:

1. Self-propelled wrapping machine movable around a load to wrap the load with a film made of plastic material in a wrapping cycle, comprising a self-propelled carriage and a upright fixed to said carriage and slidably supporting an unwinding unit provided at least with a reel of film, characterized in that it comprises:

a first gripping unit that is supported by, and connected to, said carriage, and is movable and arranged to hold and unwind an initial flap of film from said unwinding unit in an initial step of said wrapping cycle; and a second gripping unit that is supported by, and connected to, said carriage, and is movable and arranged to position and release an anchoring element on said initial flap of film unwound from said first gripping unit, in said initial step of said wrapping cycle, so as to fix said initial flap of film to a supporting plane on which said self-propelled wrapping machine moves, and to grasp and lift said anchoring element from said supporting plane so as to disengage it from said initial flap of film after at least one turn of said self-propelled wrapping machine around said load wrapping the load with said film supplied by said unwinding unit.

2. Self-propelled wrapping machine according to claim 1, wherein said first gripping unit comprises a first gripping device suitable for gripping and holding said film, said first gripping unit being movable between a picking position, in which said first gripping device is adjacent to said unwinding unit for gripping and holding said initial flap of film, and a releasing position, in which said first gripping device is spaced from said unwinding unit so as to unwind said initial flap of film.

3. Self-propelled wrapping machine according to claim 2, wherein said first gripping unit comprises a cutting device arranged for cutting said film that is supplied by said unwinding unit and held by said first gripping device in a terminal step of said wrapping cycle so as to generate said initial flap, held by said first gripping device, and a terminal flap associated with said load.

4. Self-propelled wrapping machine according to claim 3, wherein said first gripping unit comprises a first slide that is slidably connected to said carriage, movable along a first operative direction parallel to said supporting plane, and supporting said first gripping device and said cutting device.

5. Self-propelled wrapping machine according to claim 1, wherein said second gripping unit comprises a second gripping device arranged for grasping and holding said anchoring element, said second gripping unit being movable between a raised position, in which said second gripping device is spaced from said supporting plane, and a lowered position, in which said second gripping device is adjacent to said supporting plane for releasing said anchoring element on said initial flap of film and said supporting plane or for gripping and lifting said anchoring element from said supporting plane.

6. Self-propelled wrapping machine according to claim 5, wherein said second gripping unit comprises a second slide that is slidably connected to said carriage, movable along a second operative direction orthogonal to said supporting plane, and supporting said second gripping device.

7. Self-propelled wrapping machine according to claim 1, wherein said anchoring element comprises a base wall suitable for abutting and fixing said initial flap of film to said supporting plane.

8. Self-propelled wrapping machine according to claim 1, wherein said unwinding unit comprises roller assembly for pre-stretching and unwinding said film and a folding a for transversely rolling and/or narrowing said film exiting said roller assembly wherein said first gripping unit grips and holds in a terminal step of said wrapping cycle a rolled and/or narrowed portion of said film comprised between said unwinding unit and said load.

9. Self-propelled wrapping machine according to claim 1, comprising sensors for detecting dimensions of said load and/or distances between the load and said self-propelled wrapping machine during operation.

10. Method for wrapping a load by means of a self-propelled wrapping machine according to claim 1, comprising a wrapping cycle which includes:

positioning said self-propelled wrapping machine adjacent to said load in a defined initial position;

unrolling from an unwinding unit an initial flap of film by moving a first gripping unit which holds said initial flap from a picking position to a releasing position;

fixing said initial flap unwound from said unwinding unit to a supporting plane on which said wrapping machine moves, by positioning an anchoring element on said initial flap by means of a second gripping unit moved in a lowered position;

releasing said initial flap and said anchoring element disengaging said first gripping unit and said second gripping unit, respectively;

moving said self-propelled wrapping machine around said load for at least one turn, wrapping said load with said film supplied by said unwinding unit;

stopping said self-propelled wrapping machine in said defined initial position and lifting said anchoring element from said supporting plane so as to disengage said anchoring element from said initial flap of film by means of said second gripping unit moved from said lowered position to a raised position;

moving said self-propelled wrapping machine around said load for a defined number of turns and wrapping the load with said film;

stopping said self-propelled wrapping machine in a defined final position and grasping and cutting by means of said first gripping unit a portion of film comprised between said unwinding unit and said load in order to generate an initial flap of film, held by said first gripping unit, and a terminal flap associated with said load.

11. Method according to claim 10, comprising, before positioning said self-propelled wrapping machine in said defined initial position, moving said self-propelled wrapping machine around the load for at least one turn in order to calculate and identify said defined initial position.

12. Method according to claim 10, comprising, before stopping said self-propelled wrapping machine in said defined final position, transversely rolling and/or narrowing said film exiting said unwinding unit.

* * * * *